United States Patent [19]

Bullard

[11] 3,957,203

[45] May 18, 1976

[54] MOBILE REFRACTORY GUNNING DEVICE

[75] Inventor: Haran W. Bullard, Mountain Brook, Ala.

[73] Assignee: United States Steel Corporation, Pittsburgh, Pa.

[22] Filed: Apr. 18, 1975

[21] Appl. No.: 569,631

Related U.S. Application Data

[63] Continuation of Ser. No. 491,079, July 23, 1974, abandoned.

[52] U.S. Cl. ..... 239/128; 118/317; 239/165; 239/187; 239/281

[51] Int. Cl.[2] ..... B05B 13/06; B05B 16/08; B05C 7/02

[58] Field of Search ..... 239/128, 132.1–132.5, 239/146, 159, 160, 164–166, 169, 172, 176, 184–187, 225, 227, 264, 265, 587, 588, 281; 169/24; 118/317, 319, 323; 134/172

[56] References Cited

UNITED STATES PATENTS

| | | | |
|---|---|---|---|
| 2,383,023 | 8/1945 | Sykes et al. | 118/317 X |
| 3,130,077 | 4/1964 | Burden | 239/187 X |
| 3,276,695 | 10/1966 | Giardino et al. | 239/172 X |
| 3,362,642 | 1/1968 | Freeman et al. | 239/186 |
| 3,473,737 | 10/1969 | Bowman | 239/187 |
| 3,662,709 | 5/1972 | Janco | 239/184 X |
| 3,797,745 | 3/1974 | Haus | 239/227 |
| 3,827,633 | 8/1974 | Kouno et al. | 239/132.3 |

*Primary Examiner*—John J. Love
*Assistant Examiner*—Andres Kashnikow

[57] ABSTRACT

A mobile gunning apparatus is disclosed that is particularly adapted for applying refractory material to the interior of coke ovens, or the like. The apparatus is arranged for mounting on a wheeled vehicle and includes an extendable boom carrying the gunning nozzle and structure enabling the boom and nozzle to be universally movable with respect to the vehicle.

8 Claims, 6 Drawing Figures

MOBILE REFRACTORY GUNNING DEVICE

This is a continuation of application Ser. No. 491,079, filed July 23, 1974, now abandoned.

The invention relates to a refractory gunning apparatus for lining and patching the interior of refractory lined chambers particularly for use in those chambers relating to the manufacture of steel. The apparatus is especially useful in hot coke ovens for patching cracks and spalled areas in the refractory linings of such ovens.

Modern coke ovens generally consist of a plurality of narrow, elongated horizontal ovens arranged side by side in groups called batteries. Ovens are generally less than two feet in width and commonly have lengths of about forty feet and heights ranging from ten to fifteen feet. Each end of a coke oven carries a brick-lined removable door. The side walls of a coke oven are constructed of silica-brick set in silica mortar which forms a ceramic bond at high temperatures.

During the coking process the intense heat often causes large cracks to occur in the refractory walls of the oven and may also cause spalling with the wall surface. Such cracks must be sealed with a silica refractory material to prevent leakage of volatile gases into the flues from whence such gases would be exhausted to the atmosphere via the battery stack. Spalled areas, if not restored to the original wall configuration, cause the formation of "stickers", the coke in the oven expanding to fill the cross-section in a spalled region which then resists being pushed through the narrower portion of the oven upon completion of the coking process.

Heretofore, patching of cracks and spalled areas has been accomplished by utilizing conventional refractory spray devices equipped with various lengths of small diameter pipes. These pipes allow manual manipulation of the spray nozzle through doors or charging holes into oven chambers to reach and patch the cracked or spalled regions. The intense heat of the coke ovens subjects repair personnel to considerble physical discomfort. Restricted openings through which apparatus must be inserted to accomplish the repairs and the physical effort required to manipulate long sections of pipe often result in inadequate patching of cracked and spalled areas which causes continued gas leakage and difficulties in coke pushing. Further, this method of patching is slow and inefficient particularly where a multi-battery coke plant requires a large volume of repair work.

The closest known prior art is Bowman U.S. Pat. No. 3,473,737.

It is the primary object of this invention to provide an apparatus for delivering gunning material to the inside of a furnace or oven, which apparatus is readily portable from oven to oven, and has sufficient maneuverability to manipulate a refractory spray nozzle to any given area within the oven.

It is also a object to provide a refractory gunning apparatus for lining and patching the interior of refractory-lined chambers which responds instantly to control.

It is another object to provide an apparatus in which a nozzle is movable vertically, rotationally about a vertical axis, laterally along the horizntal plane, tiltably about a horizontal axis, and rotationally 360° about an axis normal to the tilting axis.

It is another object to provide an apparatus readily controllable by a single individual.

It is also an object to provide an apparatus which is unaffected by intense heat.

It is another object to provide an apparatus which is safe to operate.

It is also an object to provide an apparatus which is readily transportable from one area of operation to another.

These and other objects will become more readily apparent by referring to the following detailed specification and appended drawings in which.

Figure 1:
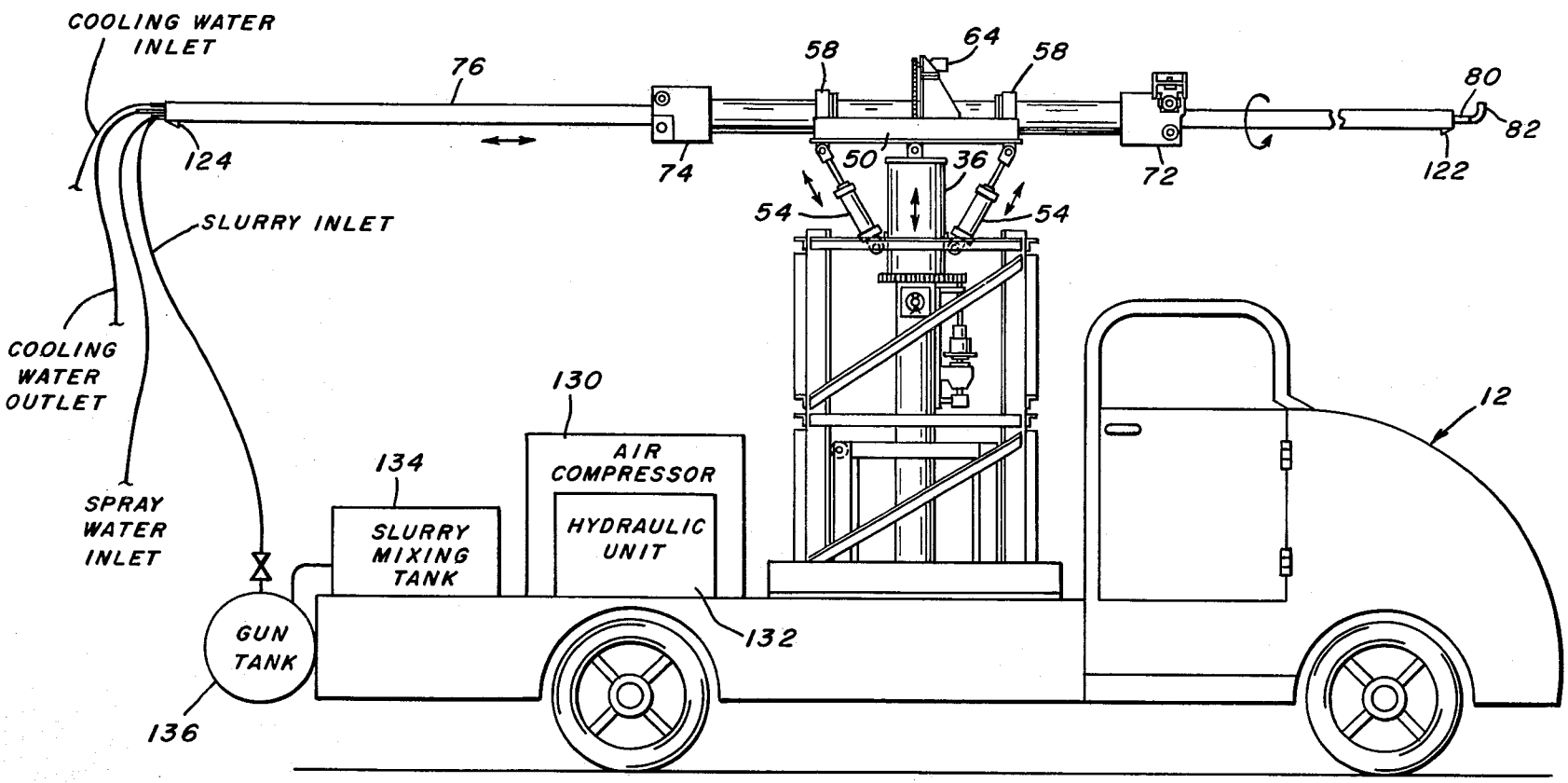
FIG. 1 is a side elevational view of my invented mobile refractory gunning apparatus mounted on a truck.
Figure 2:
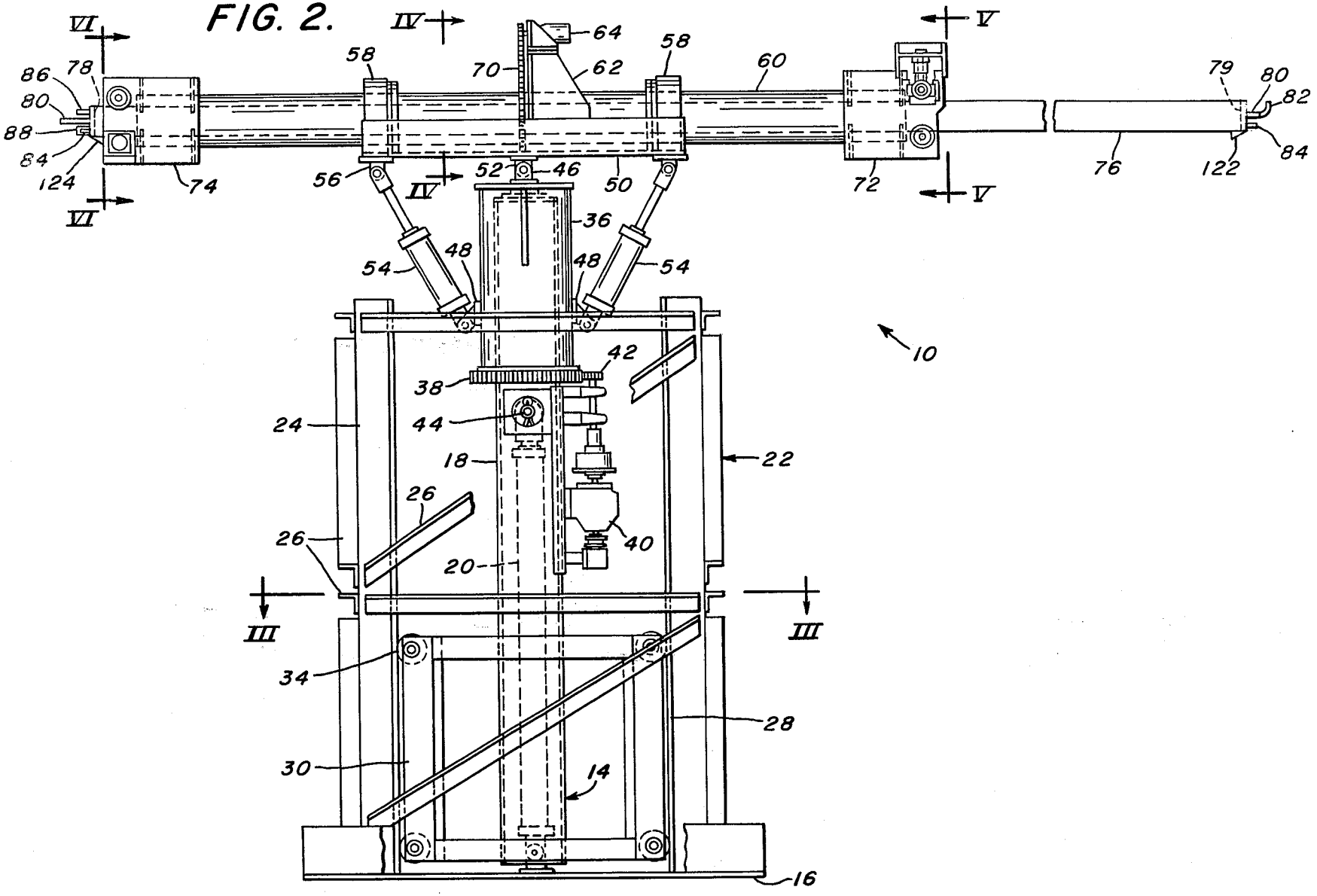
FIG. 2 is a side elevational view of my refractory gunning apparatus on a larger scale than that of FIG. 1.

My refractory gunning device 10 is mountable on any desired mobile carrier such as a truck 12 shown in FIG. 1. My complete operating unit consists of the transporting vehicle, my gunning device, a standard air compressor, a hydraulic system, a slurry mixing tank, a gun tank, a source of cooling water and spray water, and all necessary piping.

Figure 3:
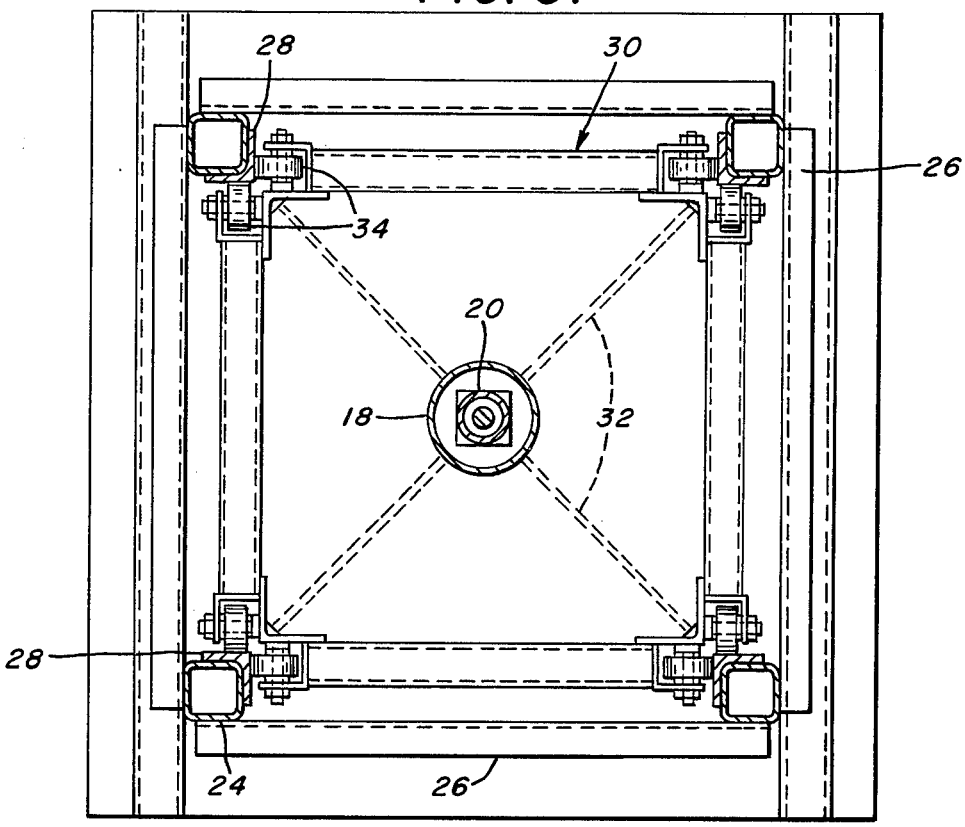
FIG. 3 is a horizontal section view of the support apparatus taken along the line III—III of FIG. 2.

Mast 14 is mounted on a base 16, which is this case is the bed of truck 12. The mast consists of a sleeve 18 supported by a mast lifting cylinder 20 inside the mast sleeve. A mast track frame 22 is also fixed to base 16. The mast track frame 22 consists of four upright corner posts 24 connected outside their perimeter by a number of structural members 26 to give them the necessary rigidity. Each corner post 24 carries a wear plate 28 or wear angle as shown in FIG. 3. Mast carriage 30, which rides inside mast track frame 22, is a cage fastened to mast sleeve 18 by connecting plates 32. At each upper and lower corner of the cage, a pair of guide rolls 34 are journaled to the cage for vertical movement of the carriage.

A mast cap 36 which is a cylinder closed at the top and open at the bottom is situated atop the mast sleeve 18. The internal diameter of the mast cap is very slightly larger than the external diameter of the mast sleeve. This very close tolerance prevents play in the apparatus and allows the gunning apparatus to place material accurately. An annular gear 38 is fixed to the bottom of mast cap 36. Hydraulic drive motor 40 with its associated pinion 42 is fixed to the side of mast sleeve 18. The clevis at the top of the mast lifting cylinder 20 is fastened to mast sleeve 18 by pin 44 and its associated cotter key.

Figure 4:
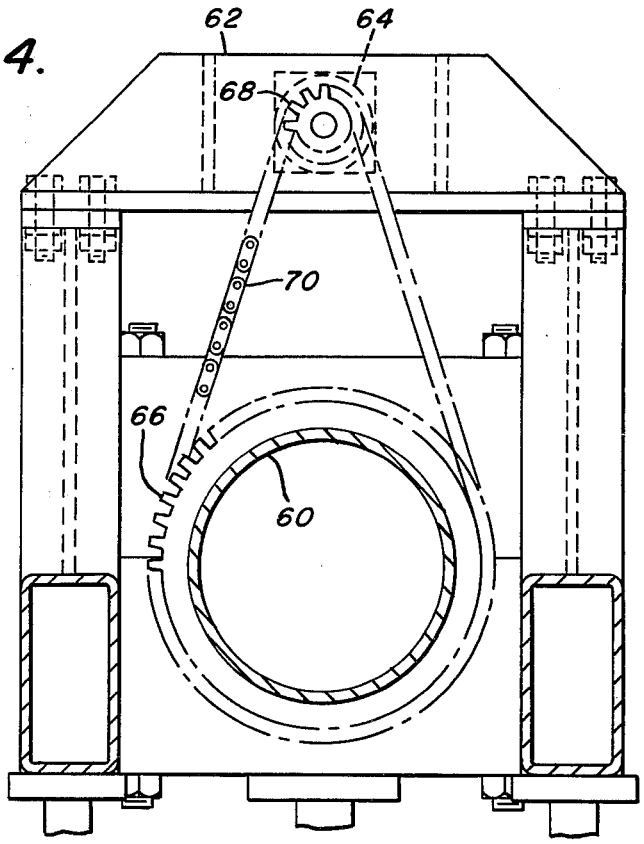
FIG. 4 is a partially sectioned view of the boom and rotational drive taken along the line IV—IV of FIG. 2.

Mast cap 36 carries mounting brackets 46 atop it and opposed mounting brackets 48 on its sides. Boom support frame 50 is attached to mounting bracket 46 by pins and matching mounting brackets 52 longitudinally centered on its underside. Tilting cylinders 54 are fastened to mast cap 36 through mounting brackets 48 and to boom support frame 50 through mounting brackets 56. Boom support frame 50 carries a pair of bearings 58 in which boom support 60 is journaled. Boom support frame 50 also carries motor support 62 upon which drive motor 64 is mounted. A large drive sprocket 66 is attached to the center of boom support 60 as shown in FIG. 4. A small drive sprocket 68 is carried by the drive shaft of motor 64. The drive force between the motor and the boom support is shown in FIG. 4. A small drive sprocket 68 is carried by the drive shaft of motor 64. The drive force between the motor and the boom support is provided by drive chain 70, which passes over both the large sprocket 66 and the small sprocket 68.

Figure 5:
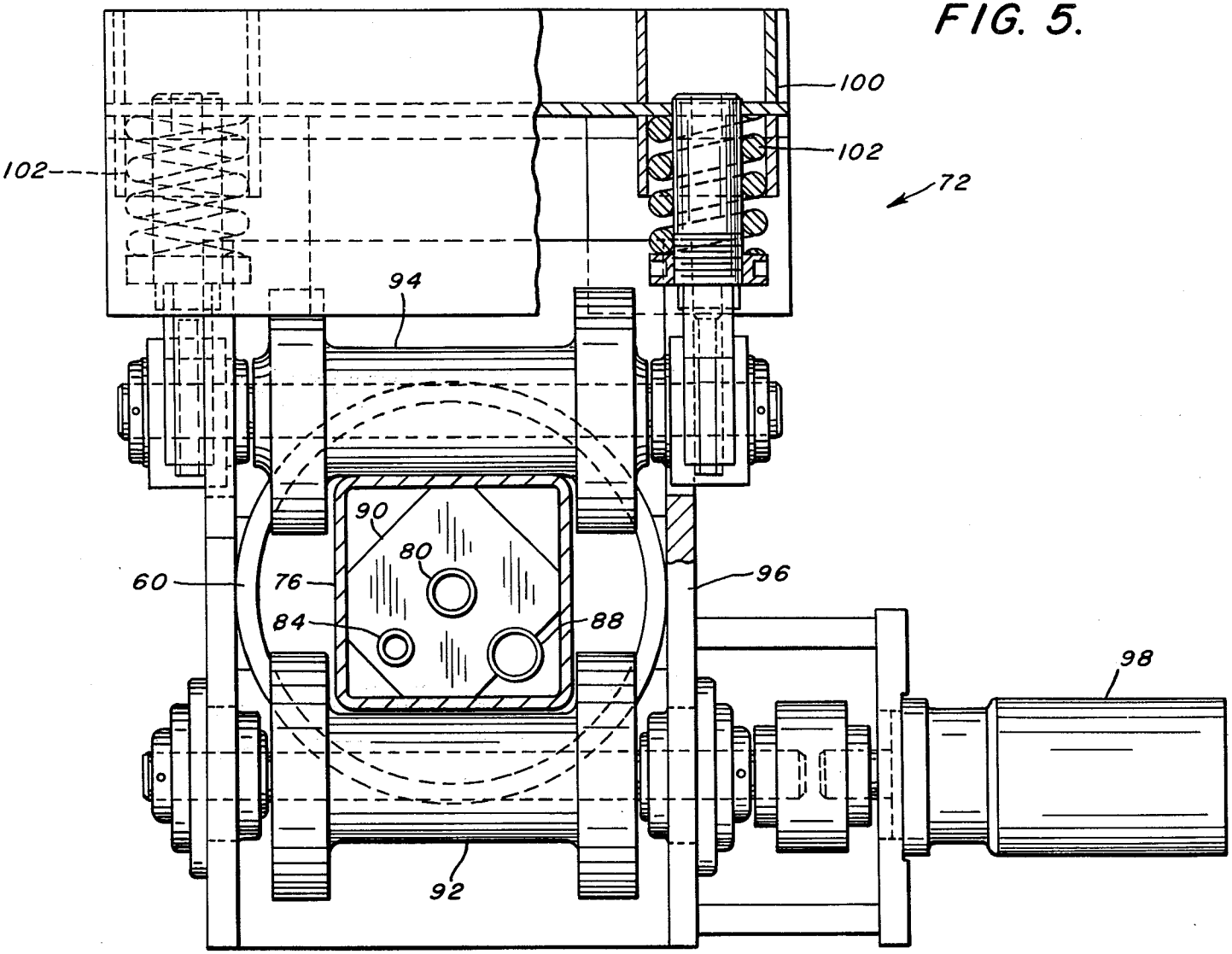
FIG. 5 is a detailed view of the front boom drive apparatus taken along the line V—V of FIG. 2.
Figure 6:
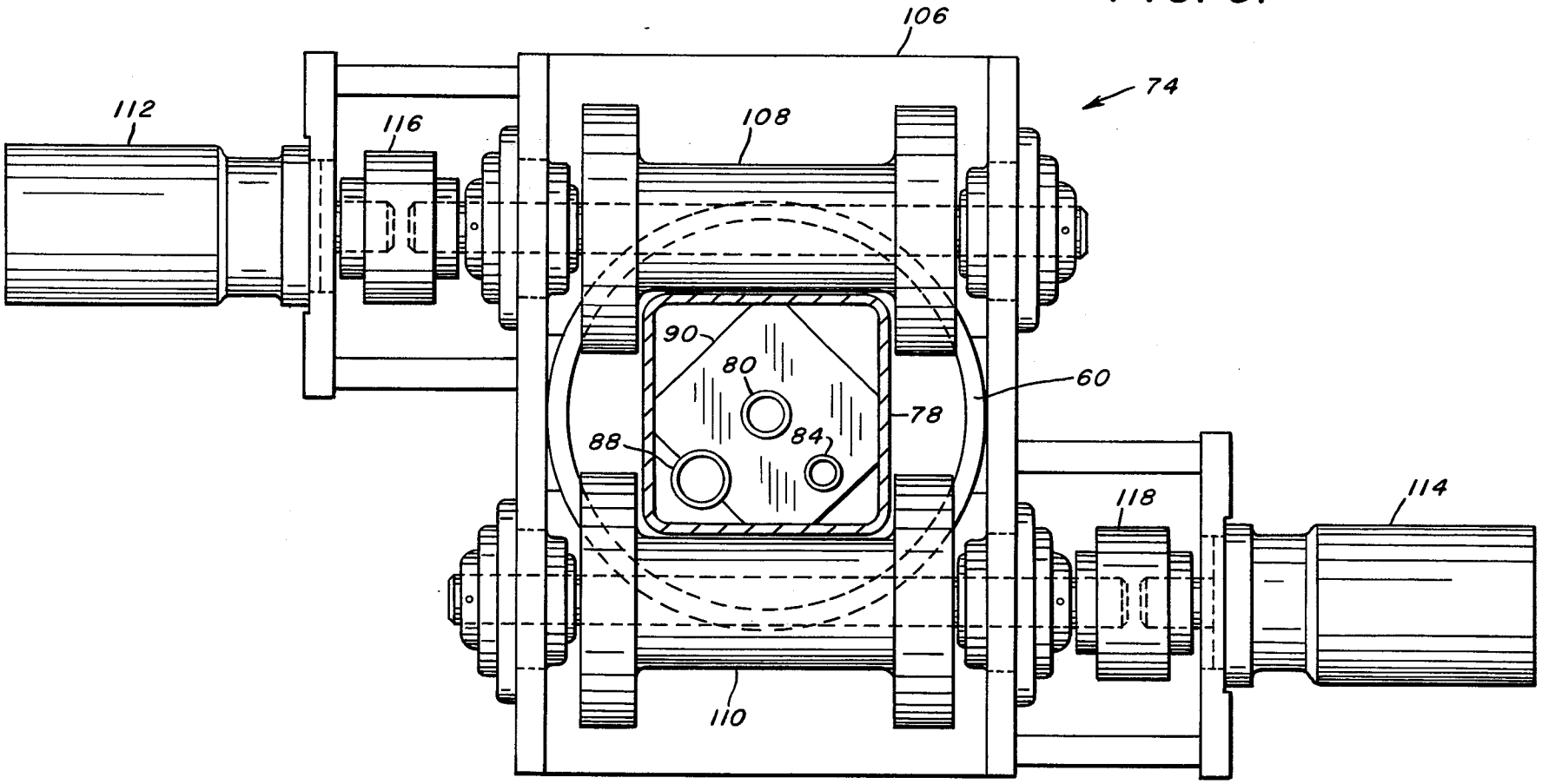
FIG. 6 is a detailed view of the rear boom drive apparatus taken along the line VI—VI of FIG. 2.

Boom support 60 also carries front boom drive 72 and rear boom drive 74. The front boom drive is determined by being nearer the end of the boom whch carries the nozzle and the rear boom drive by being nearer the end of the boom which carries the slurry and water inlets. The boom drives 72 and 74 engage a boom 76 which is a hollow structural tube having watertight seals 78 and 79 at each end to form a cooling chamber therein. The boom preferably has a square cross section as shown in FIGS. 5 and 6. Centrally situated in the boom is a slurry pipe 80 which extends completely through the boom to the spray nozzle 82, which nozzle is attached to the end of slurry pipe 80 protruding from the boom. A water spray pipe 84 is also housed in the boom. Water inlet pipe 86 is located on the rear of the boom and terminates just inside the watertight seal 78. Water outlet pipe 88 extends through the boom to a short distance from the watertight seal 79 at the nozzle end of the boom. Pipe supports 90 do not completely fill the boom but leave spaces for cooling water to flow therearound.

Front boom drive 72 comprises a pair of rollers, driven roller 92 and idler roller 94, both of which engage a surface of the boom 76. The drive support 96 also carries reversible drive motor 96 which is coupled to the drive roll 92, as well as a spring retainer 100 which houses a pair of compression springs 102, which bear against the chocks of idler roll 94.

Rear boom drive 74 includes a drive support 106 which carries a pair of driven rollers 108 and 110, with their respective reversing drive motors 112 and 114 and their respective couplings 116 and 118. Stops 122 and 124 are fixed to the front and rear of the boom respectively to prevent the boom from overextending or from overretracting during its traversing motion.

Also carried on the vehicle 12 are an air compressor 130, a hydraulic unit 132, a slurry mixing tank 134 and a gun tank 136. Air compressor 130 provides the compressed air required to pump the slurry from the gun tank through the slurry pipe 80. Hydraulic unit 132 provides all of the required hydraulic pressure to operate each hydraulic cylinder and each hydraulic motor. The hydraulic connecting lines are not shown in the drawings since each of these is conventional. Slurry mixing tank 134 acts as a holding tank or as a mixing tank in which dry gunning material is mixed with water to form a slurry.

My mobile refractory gunning apparatus is capable of five motions after being transported to the working site. The boom and nozzle can be raised in elevation by actuaing mast lifting cylinder 20. This moves all of the apparatus upward within the mast track frame 22, includng mast carriage 30. Mast carriage guide rolls 34 bear against wear plates 28 in opposite directions and at vertically spaced distances. This prevents any bending moment from being exerted on the mast 14 during movement of the boom.

When reversing hydraulic drive motor 40 is actuated, pinion 42 engages annular gear 48 on mast cap 36 initiating rotational movement of the mast cap and boom apparatus about the vertical axis of mast 14. Of course, the mast cap can be rotated in either a clockwise or counterclockwise direction.

Double acting cylinders 54 are actuated to tilt the boom 76 about the horizontal axis of the pin in mounting bracket 52. Both cylinders 54 are powered simultaneously in opposite directions, that is, one cylinder rod is extended while the other cylinder rod is retracted to tilt the boom.

Boom support 60 is rotated about its longitudinal axis by operation of reversing hydraulic drive motor 64 through drive sprocket 63 and drive chain 70, which chain engages both sprocket 68 and drive sprocket 66 on boom support 60. Since the boom 76 is held against rotation by the rolls of the front boom drive 72 and the rear boom drive 74, rotation of the boom support 60 imparts the same angular rotation to boom 76 and in the same direction. The angular rotation allows exact aiming of the nozzle 82.

Boom 76 receives its traversing motion from the drive rolls of rear boom drive 74 and front boom drive 72. The front boom drive has a single drive roll 92, and the boom is constantly urged into contact with drive roll 92 by the action of compression springs 102 against the chocks of idler or guide roll 94. Rear boom drive 74 employs two driven rolls 108 and 110, which are driven by their associated reversing hydraulic drive motors 112 and 114.

At the work site, a source of water is connected to the cooling water inlet 86 and the water spray pipe 84. Water flows continuously through the inlet pipe, the boom and the water outlet pipe 88 to continuously cool the boom and its associated parts. Slurry in either a wet or dry form is conveyed from the gun tank 136 by a connecting hose through the slurry pipe 80 to the spray nozzle 82. Water spray pipe 84 delivers water through the boom to a water spray nozzle attached to the end of spray pipe 84 on the front end of the boom when dry silica compound is applied to damaged oven surfaces.

It is readily apparent from the foregoing that my invention is capable of accurate placement of gunning materials in a hot or cold oven which may be otherwise inaccessible; that my apparatus is capable of imparting five motions to a spray nozzle including horizontal traversing, vertical traversing, tilting, horizntal rotation and vertical rotation; and all motions are capable of being controlled by a single individual remotely from a position away from the heat of the furnace.

I claim:

1. Gunning apparatus comprising:

a. a base;

b. a boom support frame vertically spaced from said base;

c. gunning boom means operatively mounted in said boom support frame;

d. an upstanding mast interconnecting said boom support frame and said base including:

i. vertically extendable and retractable fluid motor means mounted on said base and being generaly upstanding therefrom; and ii. an elongated cylindrical sleeve having an upper end in engagement with said boom support, said sleeve concentrically enclosing said fluid motor means and being connected thereto for vertical movement in response to the extension or retraction thereof; and iii. means for rotating said boom support frame with respect to said sleeve.

2. Gunning apparatus as recited in claim 1 in which said boom support rotating means includes a mast cap, relatively rotational with respect to said sleeve, interposed between the upper end of said sleeve and said boom support frame, said mast cap being connected at its upper end to said boom support frame and having an open lower end concentrically enclosing said sleeve; and means for rotating said mast cap with respect to said sleeve.

3. Gunning apparatus as recited in claim 2 in which said rotating means further includes an annular gear fixed to said mast cap and a drive motor, including a pinion engageable with said gear, attached to said sleeve.

4. Gunning apparatus as recited in claim 2 in which said boom support frame is pivotally connected to said mast cap and said apparatus further includes a pair of oppositely acting fluid motors interconnecting said boom support frame and said mast cap on opposite sides thereof for inducing pivotal movement in the latter with respect to the axis of said mast.

5. Gunning apparatus as recited in claim 1 including:

a. a mast track frame comprising a plurality of upstanding tracks parallelly disposed with respect to the axis of said mast, and b. a mast carriage connected to said sleeve and having guide rolls engageable with said tracks.

6. A mobile refractory gunning apparatus comprising:

a. a base;

b. a substantially vertical mast connected to said base;

c. lifting means connected to said mast for moving said mast vertically;

d. a mast track frame surrounding said mast and having thereon vertical wear plates adapted to be engaged by guide rolls;

e. a mast carriage connected to said mast and having a plurality of guide rolls bearing against said wear plates;

f. a cylindrical mast cap situated atop and around said mast;

g. drive means connected to said mast and to said mast cap for rotating said mast cap about its vertical axis;

h. a boom support frame, having a generally horizontal longitudinal axis, connected to the upper extremity of said mast cap;

i. a boom support journaled for rotation in said boom support frame;

j. a boom seated in said boom support, said boom comprising a hollow structural tube closed at both ends to form a cooling chamber therein, and carrying a water inlet pipe and a water outlet pipe, each extending through one end to the interior of the boom, and a slurry pipe extending through the length of the boom and terminating in a slurry spray nozzle;

k. boom support rotating means mounted on said boom support frame and engaging said boom support for rotating said boom support about its longitudinal axis;

l. means connected to said boom support for traversing said boom along its longitudinal axis; and m. means connected to said mast cap and to said boom support frame for tilting said boom support frame and said boom and boom support about a horizontal axis.

7. Apparatus according to claim 6 wherein said boom further comprises a stop means connected to each end of said boom to prevent overextending or overretracting of said boom during its traversing motion.

8. Apparatus according to claim 6 wherein said boom further comprises a water spray pipe extendng therethrough, and a water spray nozzle connected to said water spray pipe.

* * * * *